US006854829B2

(12) United States Patent
Te

(10) Patent No.: US 6,854,829 B2
(45) Date of Patent: Feb. 15, 2005

(54) LASER-ACTUATABLE INKJET PRINTING SYSTEM AND PRINTER

(75) Inventor: Bun Chay Te, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 36 days.

(21) Appl. No.: 10/219,856

(22) Filed: Aug. 15, 2002

(65) Prior Publication Data

US 2004/0032459 A1 Feb. 19, 2004

(51) Int. Cl.[7] ..... B41J 2/16
(52) U.S. Cl. ..... 347/51; 347/2; 347/52
(58) Field of Search ..... 347/51, 52, 40, 347/9, 13, 42, 2

(56) References Cited

U.S. PATENT DOCUMENTS 5,021,808 A * 6/1991 Kohyama ..... 347/51
5,731,827 A * 3/1998 Mantell et al. ..... 347/40
6,099,108 A 8/2000 Weber et al.
6,330,857 B1 12/2001 Maximovsky et al.

OTHER PUBLICATIONS

A. C. Tam and W. D. Gill, "Photoacoustic ejection from a nozzle (PEN) for drop–on–demand ink jet printing", Applied Optics, vol. 21, No. 11, pp. 1891–1892.

* cited by examiner

*Primary Examiner*—Hai Pham
*Assistant Examiner*—Lam Nguyen

(57) ABSTRACT

A laser-actuatable inkjet printing system for printing an image from digital raster data onto a print medium is disclosed. The printing system includes at least a printhead having a laser-penetrable chamber for holding ink therein. The printhead also includes a plurality of nozzles defined through a wall of the printhead to connect to the chamber. The printing system further includes a laser for producing a laser beam that is scanned across the chamber for selectively expelling droplets of ink. The expulsion of ink is in accordance with the digital raster data. Ink is expelled through multiple adjacent nozzles simultaneously onto the print medium to form each pixel of the image.

8 Claims, 2 Drawing Sheets

LASER-ACTUATABLE INKJET PRINTING SYSTEM AND PRINTER

BACKGROUND

This invention relates to inkjet printing, and more particularly, to a laser-actuatable inkjet printing system and printer.

A prior art inkjet printer typically includes at least one printing cartridge or pen in which small droplets of ink are formed and ejected toward a printing medium. Such pens include printheads with orifice or nozzle plates having very small nozzles through which the ink droplets are ejected. Ejection of an ink droplet through a nozzle may be accomplished by quickly agitating a volume of ink adjacent to each nozzle. The agitation of ink produces an effect that forces a drop of ink through the nozzle.

One method of agitating the ink is by heating the ink with a transducer, such as a resistor, that is aligned adjacent to the nozzle. Printheads using such a technique typically has many drop generators, each of which includes a single nozzle aligned over an ink chamber that supports a resister. Such a drop generator is activated or fired in either a single-drop per pixel or multi-drop per pixel print mode. In the single-drop or binary mode, one ink drop is selectively fired from each nozzle toward a respective target pixel. For printing a pixel of a specific hue, the pixel might get one drop of yellow ink from a nozzle and two drops of cyan ink from another nozzle. To improve saturation and resolution, the multi-drop mode is used where two drops of yellow ink and four drops of cyan ink might be deposited on a target pixel to attain that particular hue. In both modes, only a single drop of ink is ejected onto the target pixel each time a drop generator is fired. Each subsequent drop is deposited on the target over a drop that has been previously deposited.

Another method of agitating the ink is with a laser beam. Such a method is disclosed in A. C. Tam and W. D. Gill, "Photoacoustic ejection from a nozzle (PEN) for drop-on-demand ink jet printing", Applied Optics, Vol. 21, No. 11, pages 1891–1892. According to the method, a laser beam is focused on ink adjacent to a nozzle to generate an ultrasonic pulse. The ultrasonic pulse on arrival at the nozzle causes a single ink drop of ink to be ejected from the nozzle.

For both methods, print quality depends on the accuracy of ink agitation adjacent to an inlet of each nozzle. In the case of thermal inkjet printing where resistors are used to heat the ink, the print quality depends on the accuracy of alignment or registration of spaced-apart nozzles over ink chambers where the resistors are located. And in the case of inkjet printing using a laser beam, the print quality depends on positioning accuracy of the laser beam over spaced-apart nozzles. Any misalignment in either case would result in an insufficient amount of ink being ejected from a nozzle. Such a misalignment will be exacerbated if there is thermal expansion of the nozzle plate and will get worse with increasing length of the nozzle plate.

Thermal inkjet printheads, such as the printhead disclosed in U.S. Pat. No. 6,099,108, Weber et al., "Method and Apparatus for Improved Ink-drop Distribution in Ink-jet Printing", with two or more nozzles per drop generator nevertheless suffer from the same disadvantage.

SUMMARY

According to an aspect of the present invention, there is provided a laser-actuatable inkjet printing system for printing an image from digital raster data onto a print medium. The printing system includes at least a printhead having a laser-penetrable chamber for holding ink therein. The printhead also includes a plurality of nozzles defined through a wall of the printhead to connect to the chamber. The printing system further includes a laser for producing a laser beam that is scanned across the chamber for selectively expelling droplets of ink. The expulsion of ink is in accordance with the digital raster data. Ink is expelled through multiple adjacent nozzles simultaneously onto the print medium to form each pixel of the image.

According to another aspect of the present invention, there is provided a laser printer including the above-described printing system.

BRIEF DESCRIPTION OF DRAWINGS

The invention will be better understood with reference to the drawings, in which.

DETAILED DESCRIPTION

Figure 1:
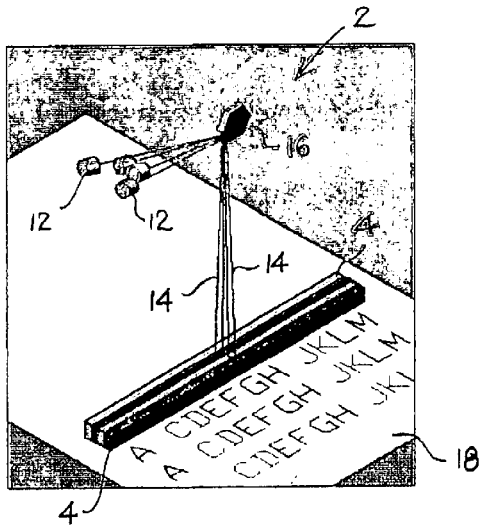
FIG. 1 is a perspective drawing of a laser-actuatable inkjet printing system according to an embodiment of the present invention.

FIG. 1 shows an embodiment of a laser-actuatable inkjet printing system 2 according to a first embodiment of the present invention. The printing system 2 includes four printheads 4. Each printhead 4 has an ink chamber 8 that is defined on one side by a laser-penetrable wall 6. Each chamber 8 holds ink of one of four different hues, namely black, yellow, cyan and magenta inks. Each of the printheads 4 further includes nozzles 10 connected to the chamber 8 that allow ink in the chamber 8 to be ejected. The printing system 2 also includes four lasers 12 for producing laser beams 14 that are scanned, using a scanner 16, across each of the four chambers 8. Each laser 12 is scanned across a respective chamber 8 to expel ink in the chamber 8 through the nozzles 10 onto a print medium 18. The nozzles 10 are sized and positioned such that multiple drops of ink are expelled by a single laser pulse of the laser beam 14 through several adjacent nozzles 10 simultaneously onto a target pixel 19 (FIG. 3) on the print medium 18. It is understood that ink of more than one hue are deposited on a pixel to obtain a particular hue.

Figure 2:
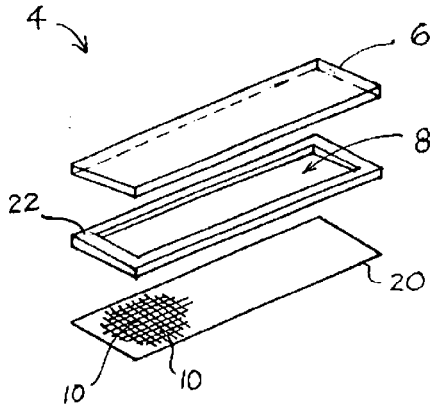
FIG. 2 is a perspective exploded drawing of a printhead used in the embodiment in FIG. 1.

FIG. 2 is a perspective exploded drawing of a first printhead 4 that can be used with the print system 2 in FIG. 1. The laser-penetrable wall 6 of the first printhead 4 is a glass plate 6 that is spaced-apart from a nozzle plate 20 by a boundary spacer 22. The spacer 22 may be a layer of adhesive of about 20–100 microns thick or a polymeric layer of similar thickness formed using a photolithography process. The glass plate 6, spacer 22 and nozzle plate 20 are glued together to define the chamber 8 for holding ink therein. The printhead 4 has a length that preferably covers the width of a widest print medium to be printed. The ink is introduced into the chamber 8 via a port (not shown) defined in the printhead 4.

The nozzle plate 20 is of a silicon wafer that is anisotropically etched to define the nozzles 10. Other materials, such as polymer-based materials used for producing flexible circuits, may also be use to build the nozzle plate 20. The nozzles 10 are evenly-spaced-apart on the nozzle plate 20 to cover an area sufficiently large to allow for positioning inaccuracy of the laser beam 14. Alternatively, the nozzles 10 may cover the entire nozzle plate to form a mesh as shown in FIG. 2. The nozzles 10 have a cross section that is square, circular or honeycomb (FIG. 3) in shape.

Each nozzle 10 has an exit orifice areal dimension that is less than $$\frac{1}{n} \times Pa$$

where n is the number of drops per pixel, and $P_a$ is the area of a pixel to be printed.

For example, if a group of four nozzles 10 expel four drops of ink onto a target pixel having an area of $(1/300)^2$ sq. in., the exit orifice of each nozzle 10 has an area less than $1/4*(1/300)^2$ sq. in. The sum of the areas of exit orifices of the group of nozzles is therefore less than the area of a pixel. In other words, the intent is to generate ink drops that will form distinct dots having a diameter less than or equal to approximately sixty microns for a target pixel having an area of $(1/300)^2$ sq. in. These dots are distributed to occupy contiguous regions of a single pixel and any remaining spaces between the dots are substantially less than twenty to twenty-five microns and are therefore invisible to the naked eye.

Figure 3:
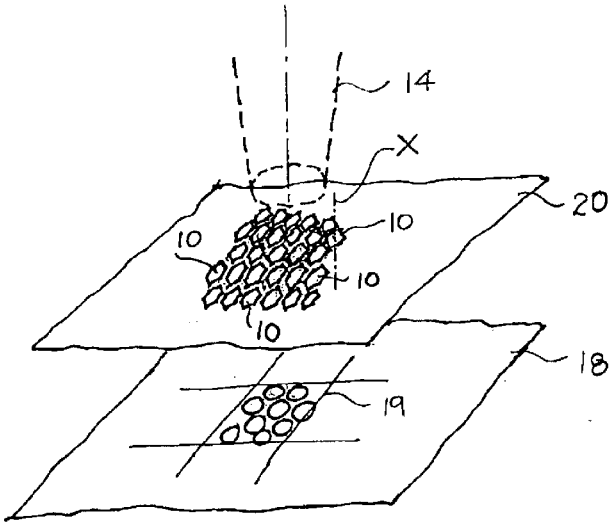
FIG. 3 is a perspective drawing showing a laser beam focused adjacent to a nozzle plate of the printhead in FIG. 2 to expel drops of ink through multiple nozzles to print on a target pixel.

Each laser 12 includes an acousto-optic modulator and either is a flashlamp pump dye laser or a Kr+-ion laser diode pumped laser. When activated, each of the lasers 12 produces a beam 14 of laser pulses. The laser beam 14 is scanned and focused at the ink in a corresponding chamber 8, adjacent to the nozzles 10. With the printhead 4 in FIG. 2, the laser beam 14 is directed at the printhead 4 substantially along the axes X of the nozzles 10 (FIG. 3).

Other types of lasers, especially those used in laser printers, may also be used with the present invention. U.S. Pat. No. 6,091,439, Nakatsuka et al., entitled "Laser printer and light source suitable for the same" and U.S. Pat. No. 6,057,867, Chan et al., entitled "Laser printer with piezoelectric apparatus to reduce banding by adjustment of a scanned laser beam" disclose two laser printers that include such lasers. It should be appreciated that the lasers may have to be adjusted or attenuated accordingly to change the power or intensity of the laser beam for use with the present invention. A laser having a pulse duration of about 10–25 nano-seconds and an irradiance of about 100 $MW/cm^2$ will be suitable for the present invention.

Ink suitable for use for the present invention may be a saturated solution of a dye in water. Other types of ink with alcohol as the solvent may also be used. In general, alcohol-type inks have larger photoacoustic ejection efficiency (i.e. a lower laser pulse energy is needed to expel the ink) compared with aqueous ink. For use with the present invention, the ink has to be optically-thick in the visible region so that a laser pulse is totally absorbed in a depth of less the one micrometer. More details of the laser 12 and ink are disclosed in A. C. Tam and W. D. Gill, "Photoacoustic ejection from a nozzle (PEN) for drop-on-demand ink jet printing", Applied Optics, Vol. 21, No. 11, pages 1891–1892.

The image scanning process disclosed in U.S. Pat. No. 6,307,584, Hirst et al., "Single Polygon Scanner for Multiple Laser Printer" for transferring digital raster data that defines an image onto a photoconductor using lasers may be used in the present invention. Instead of scanning focused laser beams on a photoconductor, the laser beams are scanned across the respective chambers 8 of the printheads 4 to be focused at ink in a chamber 8 as previously described. Briefly, the laser beams are pulsed in response to the digital raster data for selectively expelling ink onto the print medium 18 that is held in close proximity to the nozzles 10. The expelled ink from the different printheads 4 is deposited on predetermined relative positions on the print medium 18 to ensure accurate registration of the printed image. Although the print medium 18 is advanced with respect to the laser beams 14, drops of ink expelled by a laser beam 14 is preferably deposited on a pixel on a line fixed in space across which the print medium 18 is advanced.

Advantageously, the above-described printing system 2 is more tolerant towards inaccuracy in positioning of a laser beam 14 than the prior art. With a nozzle plate having evenly-spaced-apart nozzles, positioning accuracy of the laser beam 14 is no longer critical as there will be a sufficient number of nozzles directly adjacent to the laser beam to allow for positioning inaccuracy of the laser beam. A more consistent amount of ink can therefore be deposited compared to prior art systems. Moreover, printing multiple dots in a pattern for each pixel achieves a print quality that approximates a higher resolution print made by conventional inkjet methodologies.

Figure 4:
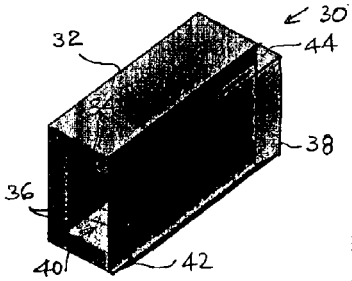
FIG. 4 is a perspective drawing of another printhead that can be used in the printing system in FIG. 1.

FIG. 4 is a perspective drawing of a second printhead 30 that can be used with the printing system 2 in FIG. 1. The second printhead 30 includes a trough 32 with a brim 34. The trough is preferably of silicon. The brim 34 has a surface that has evenly spaced-apart grooves 36 defined thereon. A laser-penetrable glass plate 38 is attached to the trough 32 to cover the brim 34 to define an ink chamber 40 therein. When the glass plate 38 is attached to the trough 32 in this manner, the glass plate 38 covers the grooves 36 to form individualized nozzles 36 that are arranged side-by-side in a row. Alternatively, grooves may be defined on a surface of the glass plate 38. The glass plate 38 has a chamfered edge 42 that is aligned opposite the nozzles 36.

Figures 5A, 5B:
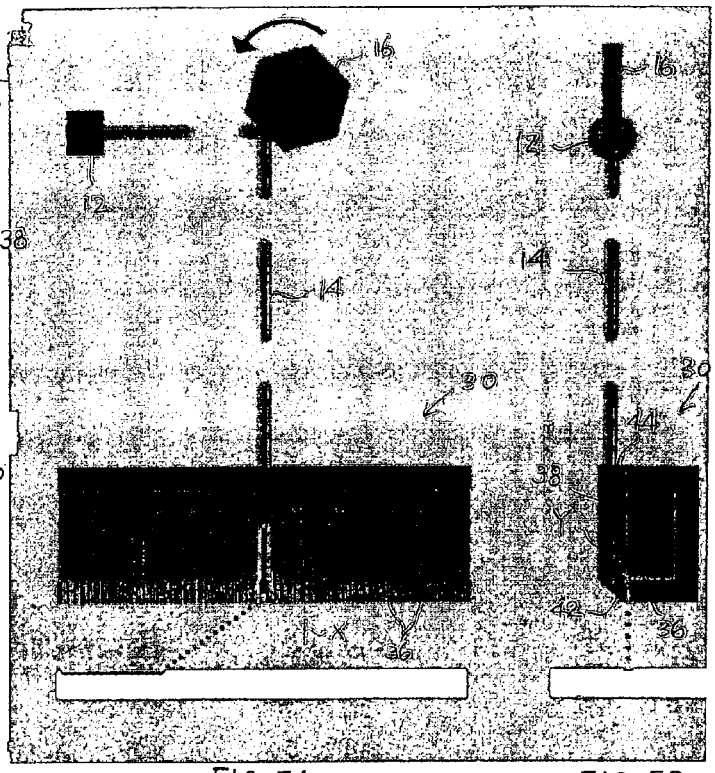
FIGS. 5A and 5B are drawings showing a front view and a side view of the printhead in FIG. 4 during use when a laser beam is scanned across the printhead to expel ink droplets.

FIGS. 5A and 5B are drawings showing a front view and a side view of the second printhead 30 in FIG. 4 during use. Ink is introduced into the chamber 40 through an input port (not shown). A laser beam 14 as previously described is scanned across an edge 44 of the glass plate 38 opposing the chamfered edge 42. The laser beam 14 travels through the glass plate 38 and is deflected by the chamfered edge 42, which functions as a deflector, onto the nozzles 36. The laser beam 14 is therefore redirected at an angle Y to its original path to be at a predetermined angle, in this case substantially orthogonal, to the axes X of the nozzles 36 to cause perturbation of ink within the nozzles 36. Each laser pulse causes perturbation of ink in at least two nozzles 36 to cause at least two drops of ink to be expelled. Since the nozzles 36 are arranged in a row, a relatively consistent amount of ink can still be expelled even if there is inaccuracy of positioning of the laser beam 14.

Figure 6:
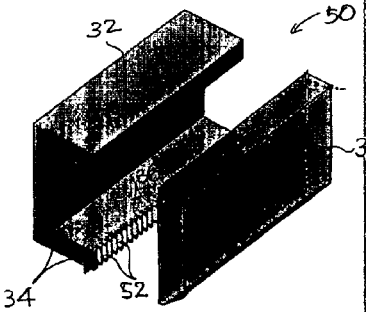
FIG. 6 is a perspective drawing of yet another printhead that can be used in the printing system in FIG. 1.

FIG. 6 is a perspective drawing of a third printhead 50 that can be used in the printing system 2 in FIG. 1. Structurally, this third printhead 50 is largely similar to the second printhead 30 in FIG. 4. The third printhead 50 however has many individually-activatable transducers, such as resistors 52, each of which heats ink in an associated nozzle 36. The resistors 52 are supported in the nozzles 36. The resistors 52 are activated, by passing electric current through them, in synchronization with the laser pulses of the laser beam 14 to assist expulsion of ink out of the nozzles 36. The intensity of the laser beam 14 that is required is thus lower than that required for the second printhead 30 in FIG. 4. The resistors 52 may be built according to a process disclosed in U.S. Pat. No. 4,809,428, Aden et al., "Thin film device for an inkjet printhead and process for the manufacturing same."

The printing system 2 in FIG. 1 may be implemented in a printer by those skilled in the art. A detailed description of such an implementation is therefore not included in this description.

Although the present invention is described as implemented in the above-described embodiments, it is not to be construed to be limited as such. For example, other types of transducers may be used in place of the resistors in the third printhead 50. And instead of having individually-activatable sub-transducers, a single common transducer that straddles the nozzles may be used. This common resistor may be activated in synchronization with laser pulses of the laser beam.

As another example, a continuous-wave laser may also be used instead of a pulsed laser.

I claim:

1. A laser-actuatable inkjet printing system for printing an image from digital raster data onto a print medium, the printing system comprising:

at least a printhead having a laser-penetrable chamber for holding ink therein, said chamber being defined by a plurality of walls, one of which is a laser-penetrable wall;

a plurality of nozzles formed through a wall of the chamber for expelling droplets of ink from the chamber to the print medium; and a laser for producing a laser beam that is scanned across the chamber to selectively expel droplets of ink, in accordance with the digital raster data, through multiple adjacent nozzles simultaneously onto the print medium to form each pixel of the image, wherein said laser-penetrable wall has a chamfered edge, and wherein the laser beam is guided through the laser-penetrable wall and is deflected by the chamfered edge onto the ink within the nozzles.

2. A laser-actuatable inkjet printing system according to claim 1, wherein the chamber is defined by a trough having a brim that is attached to the laser-penetrable well end wherein the nozzles are defined by grooves on a surface of at least one of the brim and the laser-penetrable wall.

3. A laser-actuatable inkjet printing system according to claim 2, further comprising at least one transducer for heating ink in the nozzles.

4. A laser-actuatable inkjet printing system according to claim 3, wherein the at least one transducer comprises a plurality of individually-activatable sub-transducers, each of which is associated with and heats ink in one of the plurality of nozzles.

5. A printer for printing an image from digital raster data onto a print medium comprising:

at least a printhead having a laser-penetrable chamber for holding ink therein, said chamber being defined by a plurality of walls, one of which is a laser-penetrable wall;

a plurality of nozzles formed through a wall of the chamber for expelling droplets of ink from the chamber to the print medium; and a laser for producing a laser beam that is scanned across the chamber to selectively expel droplets of ink, in accordance with the digital raster data, through multiple adjacent nozzles simultaneously onto the print medium to form each pixel of the image, wherein said laser-penetrable wall has a chamfered edge, and wherein the laser beam is guided through the laser-penetrable wall and is deflected by the chamfered edge onto the ink within the nozzles.

6. A printer according to claim 5, wherein the chamber is defined by a trough having a brim that is attached to the laser-penetrable wall and wherein the nozzles are defined by grooves on a surface of at least one of the brim and the laser-penetrable wall.

7. A printer according to claim 6, further comprising at least one transducer for heating ink in the nozzles.

8. A printer according to claim 7, wherein the at least one transducer comprises a plurality of individually-activatable sub-transducers, each of which is associated with and heats ink in one of the plurality of nozzles.

* * * * *